US008124210B2

(12) United States Patent
Kim

(10) Patent No.: US 8,124,210 B2
(45) Date of Patent: Feb. 28, 2012

(54) METAL MOSAIC TILE

(75) Inventor: Jin Hyung Kim, Seoul-si (KR)

(73) Assignee: Daejin DSP Co., Ltd., Gyeongsangnam-do (KR)

( * ) Notice: Subject to any disclaimer, the term of this patent is extended or adjusted under 35 U.S.C. 154(b) by 301 days.

(21) Appl. No.: 12/465,365

(22) Filed: May 13, 2009

(65) Prior Publication Data

US 2009/0297754 A1 Dec. 3, 2009

(30) Foreign Application Priority Data

May 29, 2008 (KR) ..... 10-2008-0050183

(51) Int. Cl.
*B32B 3/14* (2006.01)
*E04F 13/072* (2006.01)
*E04F 15/06* (2006.01)

(52) U.S. Cl. ..... 428/49; 428/78; 428/615; 52/311.2; 52/311.3; 52/387

(58) Field of Classification Search ..... 428/47, 428/48, 49, 78, 594, 615; 446/69, 118, 124, 446/128; 52/311.2, 311.3, 384–387, 391, 52/392, 789.1; 273/290
See application file for complete search history.

(56) References Cited

U.S. PATENT DOCUMENTS 1,913,031 A * 6/1933 Kertes ..... 52/392
4,856,256 A * 8/1989 Tokuzo ..... 52/792.11

FOREIGN PATENT DOCUMENTS

KR 20-0294171-0000 10/2002
KR 20-0306349-0000 2/2003

* cited by examiner

*Primary Examiner* — Donald J Loney
(74) *Attorney, Agent, or Firm* — Michael J. Striker

(57) ABSTRACT

Disclosed herein is a metal mosaic tile used as the interior finishing material on the wall of a building. The tile includes a metallic board and a metallic cover. Convex parts are provided on the front of the metallic board at regular intervals and concave parts are provided on the back of the metallic board at regular intervals. The metallic cover includes a bent side plate, a top plate and an opening for accommodating at least one of the convex parts of the metallic board, and the upper surface of each convex part adheres to the top plate. The tile has high fire resistance, effectively prevents condensation from occurring, mitigates vibration or noise, has high joining strength and high attaching strength against an object to which the tile is attached, and permits the mass production of metal mosaic tile at lower cost.

2 Claims, 5 Drawing Sheets

METAL MOSAIC TILE

CROSS-REFERENCE TO RELATED APPLICATION

The invention described and claimed hereinbelow is also described in Korean Patent Application No. 2008-0050183 filed on May 29, 2008. This Korean Patent Application, whose subject matter is incorporated here by reference, provides the basis for a claim of priority of invention under 35 U.S.C. 119(a)-(d).

BACKGROUND OF THE INVENTION

1. Field of the Invention

The present invention relates generally to metal mosaic tile used as the interior finishing material on the wall of a building and, more particularly, to a metal mosaic tile including a metallic board on which convex parts are provided on the surface of the metallic board at regular intervals and concave parts are provided on the back of the metallic board at regular intervals, and a metallic cover which is attached to the convex parts of the metallic board.

2. Description of the Related Art

Stainless metallic tile disclosed in Korean U.M. Registration No. 0294171 is manufactured by compressing stainless metal, rubber reclaimed from waste tires, and flame resistant urethane such that they are integrated into a single structure. The stainless metallic tile is problematic in that the stainless metal and the reclaimed rubber (or flame resistant urethane) are easily separated from each other when the tile itself repetitively contracts or expands because of changes in temperature. Further, when the tile is attached to a wall, a mesh net for increasing an adhesive surface area between the wall and the tile must be used.

Further, stainless tile disclosed in Korean U.M. Registration No. 306349 is manufactured by compressing a stainless part having an opening and a synthetic resin body such that they are integrated into a single structure. The stainless tile is manufactured such that one or more through holes are formed in the synthetic resin body. During the construction, mortar or an adhesive fills the through holes, thus increasing the adhesive force of the tile. However, since the synthetic resin body and the stainless part having different thermal expansive coefficients are compressed and coupled with each other, the synthetic resin body and the stainless part may easily separate from each other when the tile repetitively contracts and expands due to changes in temperature.

Further, the conventional metal tiles are problematic in that rubber or synthetic resin produces poisonous combustible gas in the event of its burning in a fire, so that the tiles are harmful to humans.

SUMMARY OF THE INVENTION

Accordingly, the present invention has been made keeping in mind the above problems occurring in the prior art, and an object of the present invention is to provide a metal mosaic tile, including a metallic board having convex parts which are provided at regular intervals on the surface of the metallic board and to which a metallic cover is attached, and having concave parts which are provided at regular intervals on the back of the metallic board and in which a tile adhesive material is filled, so that joining strength between the metallic cover and the metallic board and adhesive strength between the metallic board and an object to which the tile is attached are good, and poisonous combustion gas is not produced even in the event of its burning in a fire, thus having high safety.

In order to accomplish the above object, the present invention provides a metal mosaic tile, including a metallic board, a metallic cover and an adhesive layer. Convex parts are provided on the surface of the metallic board at regular intervals and concave parts are provided on the back of the metallic board at regular intervals. The metallic cover includes a bent side plate, a top plate and an opening for accommodating at least one of the convex parts on the metallic board. Each convex part of the metallic board adheres to the top plate via the adhesive layer.

Further, the metal mosaic tile according to the present invention is constructed so that each convex part of the metallic board includes a flat portion to which the adhesive layer is applied, an inclined portion and a furrow portion, and furthermore an assembly gap is provided between the end of the side plate of the metallic cover and the furrow portion of the metallic board, and also a space is provided between the inner corner of the side plate and the convex part of the metallic board, thus smoothly discharging bubbles when the metallic board and the metallic cover are adhered to each other via an adhesive layer, therefore allowing the metallic board and the metallic cover to be evenly and firmly adhered to each other, mitigating vibration and noise, and preventing condensation.

Further, in the metal mosaic tile according to the present invention, a contact portion between the convex part of the metallic board and the top plate of the metallic cover comprises a fusion portion formed through welding.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, the present invention will be described in detail with reference to the accompanying drawings.

Figure 1:
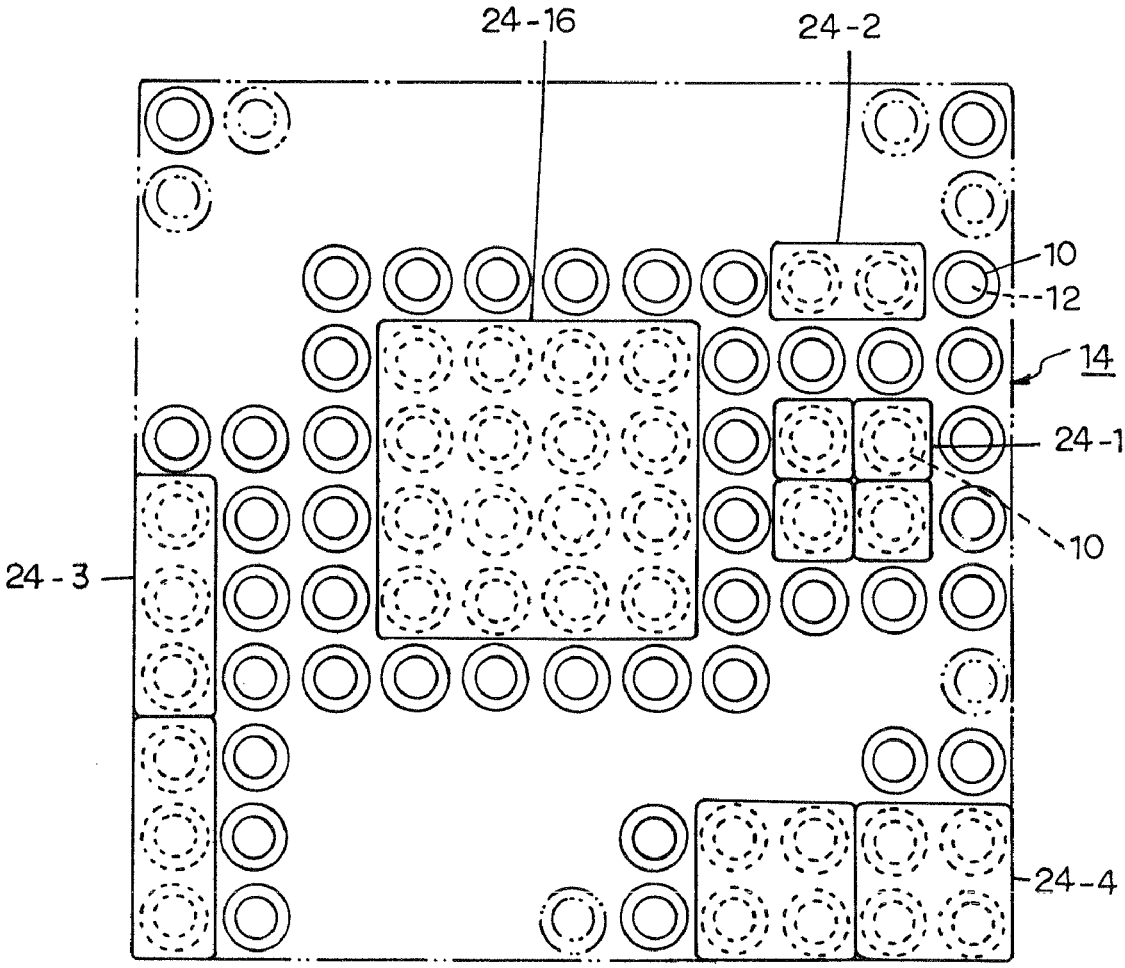
FIG. 1 is a plan view illustrating a metal mosaic tile according to an embodiment of the present invention, in which the metal mosaic tile includes one metallic board having thereon convex parts at regular intervals and a plurality of metallic covers of various sizes.
Figure 2:
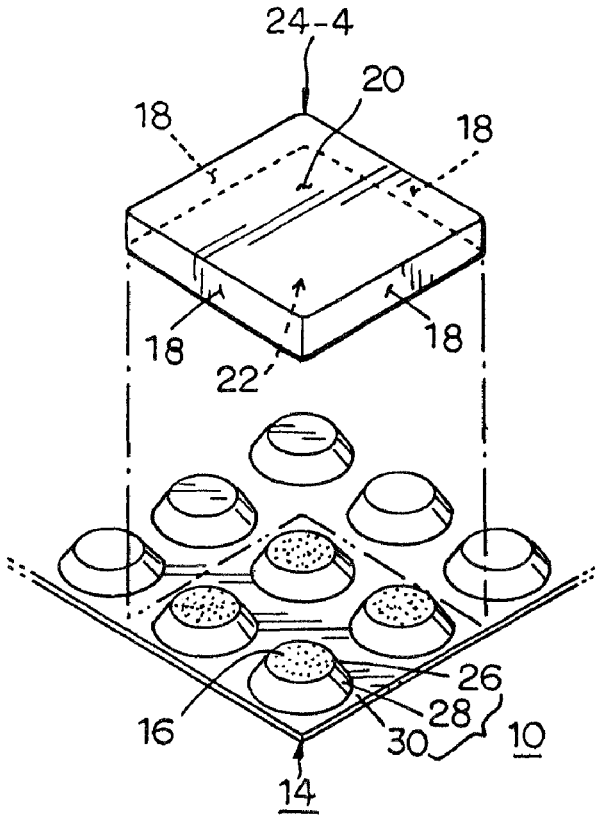
FIG. 2 is an exploded perspective view illustrating the metal mosaic tile according to the present invention as the metallic cover is being attached to the metallic board of the present invention.
Figure 3:
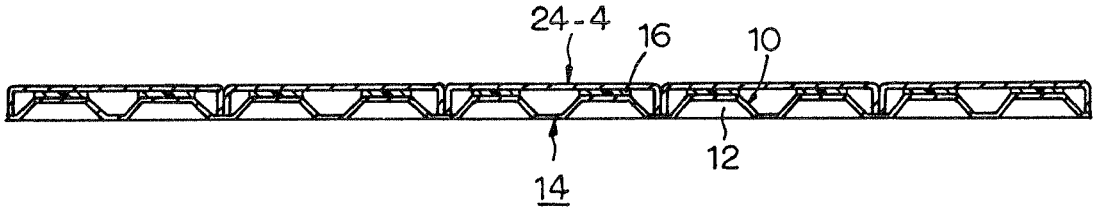
FIG. 3 is a vertical sectional view illustrating the metal mosaic tile according to the present invention, in which each of the metallic covers having a size corresponding to two or more convex parts provided on the metallic board is attached to the metallic board.
Figure 4:
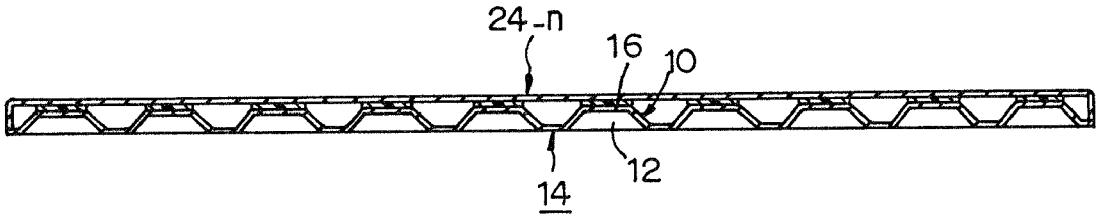
FIG. 4 is a vertical sectional view illustrating the metal mosaic tile according to the present invention, in which the metallic cover having a size corresponding to all of the convex parts provided on the metallic board is attached to the metallic board.
Figure 5:
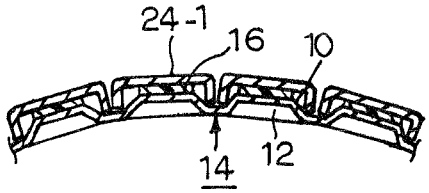
FIG. 5 is a vertical sectional view illustrating part of the metal mosaic tile according to the present invention, in which the metallic cover having a size corresponding to one convex part provided on the metallic board is attached to the metallic board, and the metal mosaic tile is curved.

FIG. 1 is a plan view illustrating a metal mosaic tile according to an embodiment of the present invention, in which the metal mosaic tile includes a metallic board having on its surface convex parts at regular intervals and a plurality of metallic covers of various sizes. FIG. 2 is a perspective view illustrating the state in which the metallic cover is being attached to the metallic board according to the present invention. FIG. 3 is a vertical sectional view illustrating the state in which each of the metallic covers having an opening of a size corresponding to two or more convex parts provided on the metallic board according to the present invention is attached to the metallic board. FIG. 4 is a vertical sectional view illustrating the state in which the metallic cover having an opening of a size corresponding to all of the convex parts provided on the metallic board according to the present invention is attached to the metallic board. FIG. 5 is a vertical sectional view illustrating part of the curved metal mosaic tile according to the present invention, in which each of the metallic covers having a size corresponding to one convex part provided on the metallic board according to the present invention is attached to the metallic board.

Figure 6:
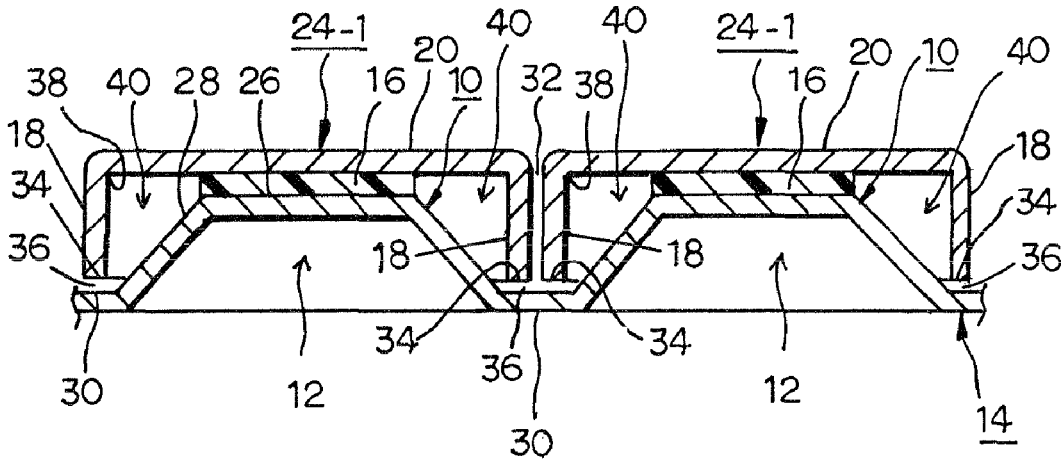
FIG. 6 is an enlarged vertical sectional view illustrating the state in which the metallic board and the metallic covers of the metal mosaic tile according to the present invention are attached to each other.

FIG. 6 is an enlarged vertical sectional view illustrating part of the metal mosaic tile according to the present invention.

Figure 7:
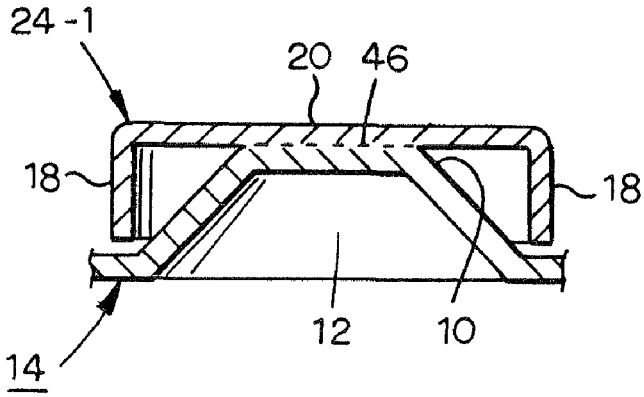
FIG. 7 is an enlarged vertical sectional view illustrating part of a metal mosaic tile according to another embodiment of the present invention using a welding process.

FIG. 7 is an enlarged vertical sectional view illustrating part of a metal mosaic tile according to another embodiment of the present invention using a welding process.

Figure 8:
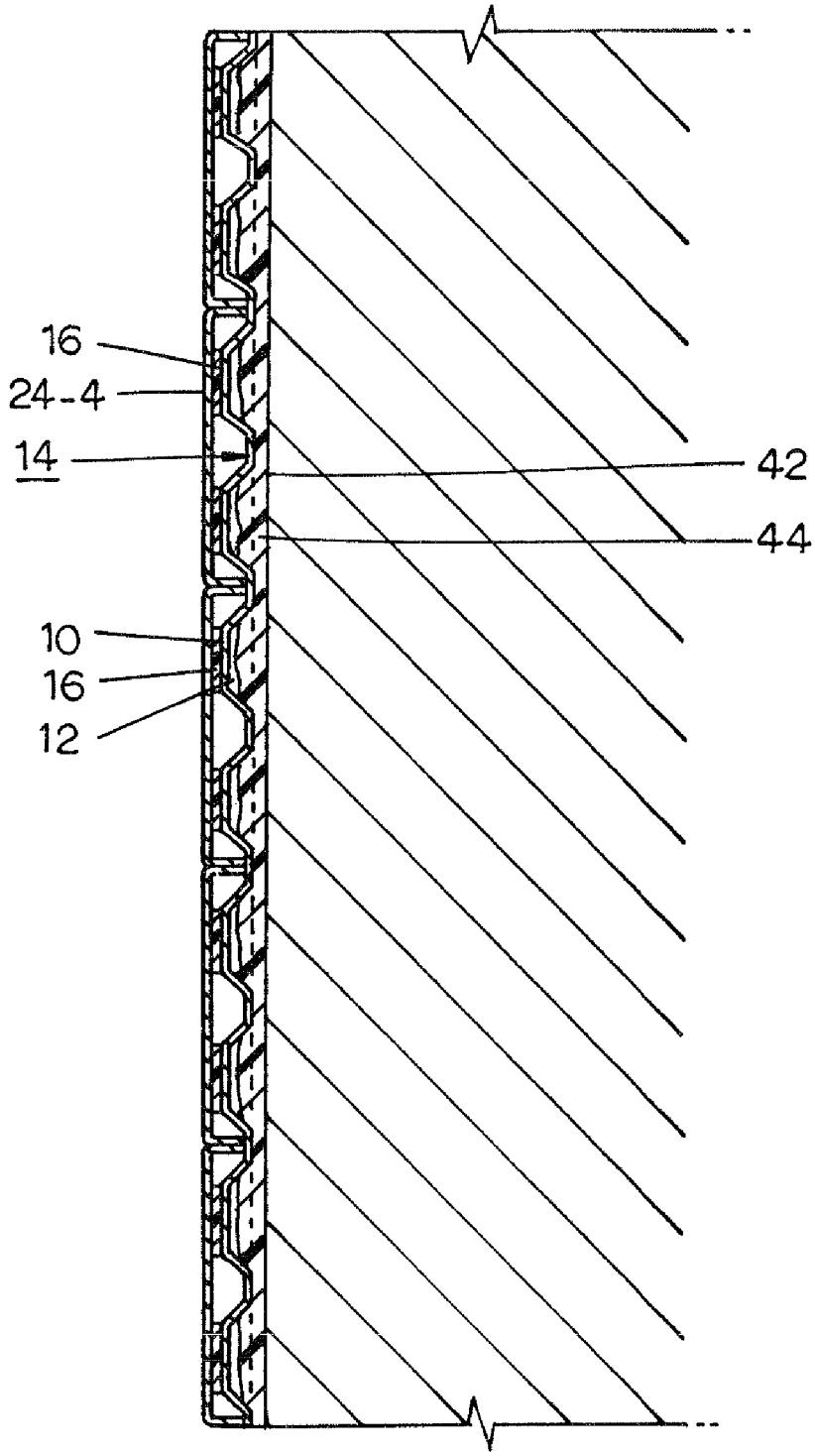
FIG. 8 is a sectional view illustrating the state in which the metal mosaic tile according to the present invention is attached to a wall.

FIG. 8 is a sectional view illustrating the state in which the metal mosaic tile according to the present invention is attached to a wall.

As shown in FIGS. 1 to 6, the metal mosaic tile according to an embodiment of the present invention includes a metallic board 14, adhesive layers 16, and metallic covers 24-1, 24-2, 24-3, 24-4, . . . , 24-16, . . . , 24-n. Convex parts 10 are provided at regular intervals on the surface of the metallic board 14, while concave parts 12 are provided at regular intervals on the back of the metallic board 14. The adhesive layers 16 are applied to the convex parts 10 of the metallic board 14. Each metallic cover includes bent side plates 18, a top plate 20, and an opening 22 having a size for accommodating 1 to n convex parts 10 provided on the metallic board 14.

The metallic board 14 is formed by pressing a stainless steel plate having a thickness from 0.2 to 0.4 mm such that the convex parts 10 are provided on the surface of the stainless steel plate and the concave parts 12 are provided on the back of the stainless steel plate.

Each adhesive layer 16 is selected from the group including a hot melt adhesive and an epoxy adhesive.

Each metallic cover 24-1, . . . , or 24-n is formed by pressing the stainless steel plate having the thickness of from 0.2 to 0.4 mm.

In the present invention, as shown in FIG. 6, each convex part 10 of the metallic board 14 includes a flat portion 26 to which the adhesive layer 16 is applied, an inclined portion 28 and a furrow portion 30. An assembly gap 32 is defined between the side plates 18 of neighboring metallic covers 24-1, . . . , 24-n, and an assembly gap 36 is defined between the end of each side plate 18 and the furrow portion 30 of the metallic board 14. A space 40 is provided between the inner corner 38 of each side plate 18 of each metallic cover 24-1, . . . , or 24-n and each convex part 10 of the metallic board 14.

Thus, the thin metallic board 14 of a 0.2 to 0.4 mm thickness has superior form stability and evenly distributes load or shocks applied from the metallic covers 24-1, . . . , and 24-n around the convex parts 10 of the metallic board 14 or mitigates the load or shocks.

Further, the space 40 defined between each convex part 10 of the metallic board 14 and each metallic cover 24-1, . . . , or 24-n, and each concave part 12 provided on the back of the metallic board 14 remarkably mitigate vibration or noise transmitted from the metallic covers 24-1, . . . , and 24-n or a wall on which the tiles are attached.

The use of the metal mosaic tile according to the present invention constructed as such is shown in FIG. 8.

As shown in FIG. 8, in the metal mosaic tile according to the present invention, a tile adhesive material 44 such as a general synthetic resin adhesive, tile cement or mortar is applied to the back of the metallic board 14 or the wall 42 of a building to which the tiles are to be set, and thereafter, the tiles are set to the wall 42. In the state where the tile adhesive material 44 is pushed into the concave parts 12 provided on the back of the metallic board 14, the tile adhesive material 44 hardens.

Thus, the metal mosaic tile according to the present invention is very firmly attached to the wall 42 of the building without using a mesh net for increasing adhesive surface area, unlike the conventional tile.

Further, in the metal mosaic tile according to the present invention, the assembly gaps 32 and 36 and the space 40 defined between the metallic board 14 and the metallic covers 24-1, . . . , and 24-n serve as an air discharge passage for discharging air present between each convex part 10 of the metallic board 14 and the top plate 20 of each metallic cover 24-1, . . . , or 24-n when each convex part 10 of the metallic board 14 is attached to the top plate 20 of each metallic cover by the adhesive layer 16, so that bubbles are not generated in the adhesive layer 16. Consequently, the metallic covers 24-1, . . . , and 24-n are more evenly and firmly attached to the metallic board 14, and the assembly gaps 32 and 36 and the space 40 reduce a difference in temperature between the interior of a building and the wall 42, thus effectively preventing condensation due to a large difference in temperature.

FIG. 7 illustrates a metal mosaic tile according to another embodiment of the present invention. In the metal mosaic tile of FIG. 7, a contact portion between each convex part 10 of the metallic board 14 and the top plate 20 of each metallic cover 24-1, . . . , or 24-n comprises a fusion portion 46 which is formed through plasma welding, laser beam welding or spot welding.

In the present invention, the metallic covers 24-1, . . . , and 24-n may have various colors and patterns. For example, mosaic tiles may be manufactured through a titanium arc ion plating process or a nano-ceramic coating process.

Thus, as shown in FIGS. 2 through 6, when the surface of the metal mosaic tile according to the present invention which is constructed so that the metallic board 14 and the metallic covers 24-1, . . . , and 24-n are attached to each other using the adhesive layers 16 is treated in a vacuum chamber of high temperature, the interior of the vacuum chamber may be contaminated by the adhesive layers 16. That is, this may negatively affect the surface treatment. Therefore, preferably, each of the metallic covers 24-1, . . . , and 24-n is manufactured using a surface-treated metal plate. Thereafter, the metallic covers 24-1, . . . , and 24-n are attached to the metallic board 14 via the adhesive layers 16, thus manufacturing the metal mosaic tile.

Further, as shown in FIG. 7, the metal mosaic tile according to the present invention may be manufactured such that the metallic board 14 and the metallic covers 24-1, . . . , and 24-n are attached to each other via the fusion portions 46 formed through welding. In this case, even if the surface of the metal mosaic tile is treated in the vacuum chamber of high temperature, the interior of the vacuum chamber is not contaminated, and the metallic covers 24-1, . . . and 24-n on the metal mosaic tile can be evenly and economically treated.

As described above, the present invention provides a metal mosaic tile including a thin metallic board and a metallic cover which has the same coefficient of thermal expansion as and adheres to at least one convex part of the metallic board, so that the metal mosaic tile is light and firm, has high fire resistance, mitigates vibration or noise, effectively prevents condensation and permits the mass production of metal mosaic tile of high quality at lower cost.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A metal mosaic tile, comprising:

a metallic board on which a plurality of convex parts and concave parts are placed; and metallic covers having a bent side plate, a top plate and an opening for accommodating at least one of the convex parts, wherein each of the convex parts comprises a flat portion, an inclined portion and a furrow portion, a first assembly gap being defined between an end of the bent side plate and the furrow portion of the metallic board, a second assembly gap being defined between the bent side plates of neighboring metallic covers, a space being provided between the inclined portion of the metallic board and the bent side plate of each metallic cover, a contact portion between the flat portion and the top plate comprising an adhesive layer.

2. The metal mosaic tile as set forth in claim 1, wherein the contact portion between the flat portion and the top plate comprises a fusion portion made using a welding process.

* * * * *